US005969627A

United States Patent [19]

Tarlton et al.

[11] Patent Number: 5,969,627

[45] Date of Patent: Oct. 19, 1999

[54] AUDIBLE AND AUDIBLE-VISIBLE ALARMS WITH INTERCHANGEABLE COVER

[75] Inventors: Peter B. Tarlton, Shrewsbury; Inhong Hur, Oakhurst, both of N.J.

[73] Assignee: Wheelock, Inc., Long Branch, N.J.

[21] Appl. No.: 09/045,105

[22] Filed: Mar. 20, 1998

Related U.S. Application Data

[60] Continuation-in-part of application No. 08/876,615, Jun. 16, 1997, which is a division of application No. 08/524,865, Sep. 7, 1995.

[51] Int. Cl.[6] ..... G08B 23/00

[52] U.S. Cl. ..... 340/693.12; 340/693.5; 340/693.9; 340/693.3; 340/692; 340/691.7; 340/815.73; 340/815.74; 340/384.1; 340/391.1; 340/396.1

[58] Field of Search ..... 340/693.5, 693.9, 340/693.12, 691.3, 692, 691.7, 815.73, 815.74, 384.1, 391.1, 396.1; 362/368, 433, 439, 443, 448, 457, 458, 806, 191, 226, 238, 240, 237; 439/535, 536

[56] References Cited

U.S. PATENT DOCUMENTS

| | | | |
|---|---|---|---|
| 4,929,093 | 5/1990 | Suzuki et al. | 374/208 |
| 5,486,816 | 1/1996 | Ariga et al. | 340/630 |
| 5,621,387 | 4/1997 | Phillips et al. | 340/545.6 |
| 5,684,467 | 11/1997 | Hur | 340/693.9 |
| 5,710,541 | 1/1998 | Stanley et al. | 340/628 |
| 5,767,782 | 6/1998 | Mongeau | 340/693.9 |

OTHER PUBLICATIONS

Wheelock brochure (P82467–001F), Installation Instructions Multitone Signals MT–12/24, MT4–12/24 (1993,1994); pp. 1–4.

Wheelock brochure, "Fire Alarm Systems, Series AMT and AMT Strobe Multitone Electronic Appliances" (1997).

Wheelock brochure, "Fire Alarm Systems, Series NS/NS4 Horn Strobe Appliances—Series NH Horn Appliance" (1997).

Wheelock brochure, "Fire Alarm Systems, Series RS Strobes and Series RSS Non–Sync/Sync Strobes" (1998).

Wheelock brochure, Series MT and MT Strobe Multitone Electronic Signals; p. 8.

Wheelock Inc brochure, "Fire Alarm Systems, Series NS/NS4 Horn Strobe Appliances—Series NH Horn Appliances" 1997.

*Primary Examiner*—Benjamin C. Lee

*Attorney, Agent, or Firm*—Baker & Botts, L.L.P.

[57] ABSTRACT

The bases of an audible alarm unit and an audible/visible alarm unit are configured to be used interchangeably with a single cover. The cover has an opening that receives a projecting wall portion on the base of the audible alarm unit and a receptacle for a strobe lamp unit on the base of the audible/visible alarm unit. The bases have mounting holes that enable the alarm units to be mounted on several types of standard backboxes, the cover concealing the screw holes for good appearance of the installed units.

24 Claims, 7 Drawing Sheets

AUDIBLE AND AUDIBLE-VISIBLE ALARMS WITH INTERCHANGEABLE COVER

This application is a continuation-in-part of U.S. Pat. application Ser. No. 08/876,615, Jun. 16, 1997, which, in turn, is a divisional application of U.S. Pat. application Ser. No. 08/524,865, filed Sep. 7, 1995.

BACKGROUND OF THE INVENTION

Audible and audible-visible alarms are widely used, especially in commercial, office and institutional buildings, as elements of fire safety installations. Both audible and audible-visible alarms have a sound generator, such as a horn, bell or siren, and associated electronic circuitry for driving the sound generator. Audible-visible alarms have, in addition to the sound generator and its driving circuitry, a light source, which is universally a strobe lamp, and electronic circuitry for firing the lamp. It is well known, per se, to provide the sound generator and driving circuitry in the form of a circuit board module, which has input terminal connectors for connecting the module to signal wires that originate at a remote control unit. The control unit receives input signals from heat and smoke detectors and sets off alarms in selected zones that may become hazardous to building occupants as a result of a fire indicated by inputs from particular detectors. Similarly, strobe lamp firing circuits and the strobe light are commonly produced as circuit board electronic modules and strobe light units, the latter consisting of a mounting board and a light reflector and a strobe lamp or lamps mounted directly to the board.

Audible and audible-visible alarms are almost always mounted on walls using electrical backboxes. Many previously known alarms have had mounting plates that serve as both mountings for the alarm modules and covers that conceal the modules. Because there are several sizes and configurations of backboxes in common use, the mounting plates have been produced in different sizes and configurations for use with the different styles of backbones. Recently, the owner of the present invention has introduced alarms with universal mounting plates that have multiple sets of screw holes, each set being used with a different backbox style. The multiple screw holes make it desirable to have a cover, separate from the mounting plate on which the alarm module is mounted, to conceal the screw holes. The covers for the universal mounting plates snap on to the mounting plate and thus not only conceal the multiple screw holes and the screws but have no visible screws, which improves the appearance of the alarm as compared to mounting plates that also serve as covers and in which the screws are visible. The universal mounting plates and covers referred to above are described and shown in U.S patent application Ser. No. 08/524,865, filed Sep. 7, 1995, which application is incorporated into the present specification for all purposes.

The strobe light units of audible-visible alarms must protrude from the front of a mounting plate or cover so that the light can propagate not only away from the wall but in directions parallel to the wall. Accordingly, the covers for the universal mounting plates have a hole, through which the strobe light unit can protrude from the mounting plate. Audible alarms have no protruding element, so a cover without a hole is provided. The need for different covers for audible and audible-visible alarms increases costs in the form of design and tooling expenses and inventory stocking and control. The possibility of mistakes in ordering and delivery can produce delays in installation. If an installer does not match the units and the covers at the job site, he or she will have to exchange the non-matching covers before the job can be completed. Meanwhile, the distributor who supplied the installer will probably have a mismatch in the stocks of units and covers. In a large job, the installer will have to allocate matching units and covers for each alarm site. Mismatches will result in lost time when the installer has to go to a storage location and correct a mismatch.

SUMMARY OF THE INVENTION

An object of the present invention is to reduce the costs, possible mistakes and delays, and the inconveniences of making, stocking and selecting matched alarm units and covers. Another object is to provide audible and audible-visible alarms that are durable, easy to install and attractive in appearance.

The foregoing objects are attained, in accordance with the present invention, by an alarm assembly comprising an alarm unit selected from an audible alarm unit and an audible-visible alarm unit, and a decorative cover adapted for use interchangeably with the audible alarm unit and the audible-visible alarm unit and detachably connected to the selected alarm unit. The cover has a front wall, which has an opening for a strobe light unit, and side walls extending generally rearwardly from the front wall and defining a rear cavity containing the selected alarm unit.

The audible alarm unit with which the cover is used has a base member that is adapted to support a sound generating unit, i.e., a circuit board module having a sound generator and electronic circuitry for driving the sound generator. Sets of screw holes in selected positions in the base member provide for attaching the base member to electrical backbones of different styles. A projecting wall portion on the base plate is receivable with a close peripheral clearance in the opening in the front wall of the cover, the projecting wall portion having a front surface contoured and configured to match contours and configurations of adjacent portions of the front surface of the front wall of the cover such that the front surface of the cover and the front surface of the projecting wall portion of the base of the audible alarm unit are visually unitary. More simply put, the projecting wall portion of the base member fills the opening in the cover in a manner that makes it look like the cover does not have an opening.

The audible-visible alarm unit with which the cover is used has a base member that is adapted to support a sound generating unit and a light generating unit that includes a strobe lamp unit having a mounting plate, a strobe lamp and a transparent strobe lamp cover. The base has screw holes in selected positions adapted to receive screws by which the audible-visible alarm unit is adapted to be attached to electrical backboxes of different styles and a receptacle that is adapted to receive the strobe lamp unit. The receptacle is defined by peripheral walls that are receivable with a close peripheral clearance in the opening in the cover and project out from the front surface of the cover so as to enable light from the strobe lamp unit installed in the receptacle to be emitted laterally (parallel to a wall) and frontally (out from the wall) with respect to the front surface of the cover.

The interchangeable cover eliminates the need to design, tool up for, produce, catalog, stock, allocate and ship one cover for audible alarm units and another for audible-visible alarm units. The chances for mistakes and delays due to mismatches between covers and alarm units at the manufacturing, distributing and installing levels are eliminated. Inventory maintenance and control are simplified. At the job site, the installer does not have to select different covers for different alarms. After some or all of the alarms for the job are installed, the installer can take boxes of the covers around to the alarms and install any one of them on either of the alarm types. In some cases, however, installers may have to select and install covers that are of colors that match the colors of the alarm units.

The base member of either or both the audible alarm unit and the audible-visible alarm unit may have a front wall, from which the projecting wall portion projects as a raised protuberance, and side walls extending generally rearwardly from the front wall, the front wall and side walls forming a cavity that is adapted to receive the sound generating unit and, in the case of the audible-visible alarm unit, the light-generating unit in recessed relation with respect to rear edges of the side walls. Such a configuration locates the circuit boards, electronic components, and sound generator on the side of the base member that faces away from the cover and toward the backbox, so the base member provides protection for the modules when the cover is not installed and increases the resistance of the assembly (cover in place) to damage of the modules, should the assembly suffer an impact - the cover and part of the base member together provide a double-walled casing for the modules. Advantageously, the shapes of the perimeters of the base members of the alarm units generally match the shape of the perimeter of the cover such that the base members nest in the covers of the assemblies.

The front wall of the cover and the front wall of the base member of the audible alarm unit may have registering sound openings to facilitate transmission of sound from the sound generating unit. The sound openings may be masked visually by a grillework on the front wall of the cover, such as parallel straight grille bars extending across the sound opening. Additional parallel straight ribs adjacent the grille bars and forming a faux grille, at least some of which are aligned with and contiguous to the grille bars enhance the visual masking of the sound opening.

In order to somewhat conceal the fact that the projecting wall portion on the base member of the audible alarm is separate from the cover, it is desirable to provide projecting ribs that form a faux grille on the outer face of the projecting portion. The faux grille attracts an observer's attention as a decorative theme, thus drawing attention away from the narrow gap between the border of the opening in the cover and the edges of the projecting portion. The faux grille also graphically communicates to an observer the fact that the alarm includes a sound generator. The grille/faux grille theme is a graphic indication to an observer of a sound function of the device—a "cone-of-sound" graphic.

In preferred embodiments of the present invention, the cover is substantially rectangular, and preferably square, in front elevation, the front wall of the cover includes a substantially planar and rectangular portion and beveled side portions along margins of the planar portion, and the side walls of the cover are oriented substantially orthogonally with respect to the planar portion. The opening in the front wall of the cover is elongated and substantially rectangular in front elevation, extends entirely across the planar portion and partway along opposite beveled side portions, and is oriented with its edges parallel to the side walls of the cover. The opening in the front wall of the cover is offset with respect to a centerline of the cover parallel to a longer axis of the opening. The rectangular, preferably square, shape corresponds to that of large, square backboxes, thus adapting the alarm for universal use. The bevels on the front wall of the cover reduce the visual mass of the alarm.

For a better understanding of the invention, reference may be made to the following description of an exemplary embodiment, taken in conjunction with the accompanying drawings.

DESCRIPTION OF THE EMBODIMENT

Figure 1:
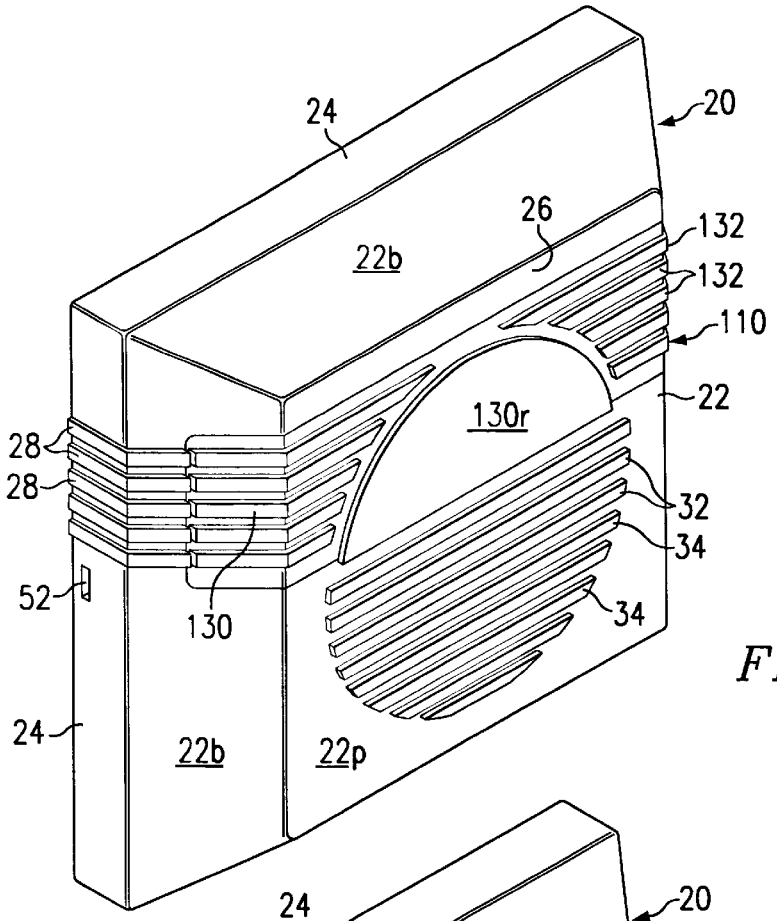
FIG. 1 is a ¾ front pictorial view of the audible alarm.
Figure 2:
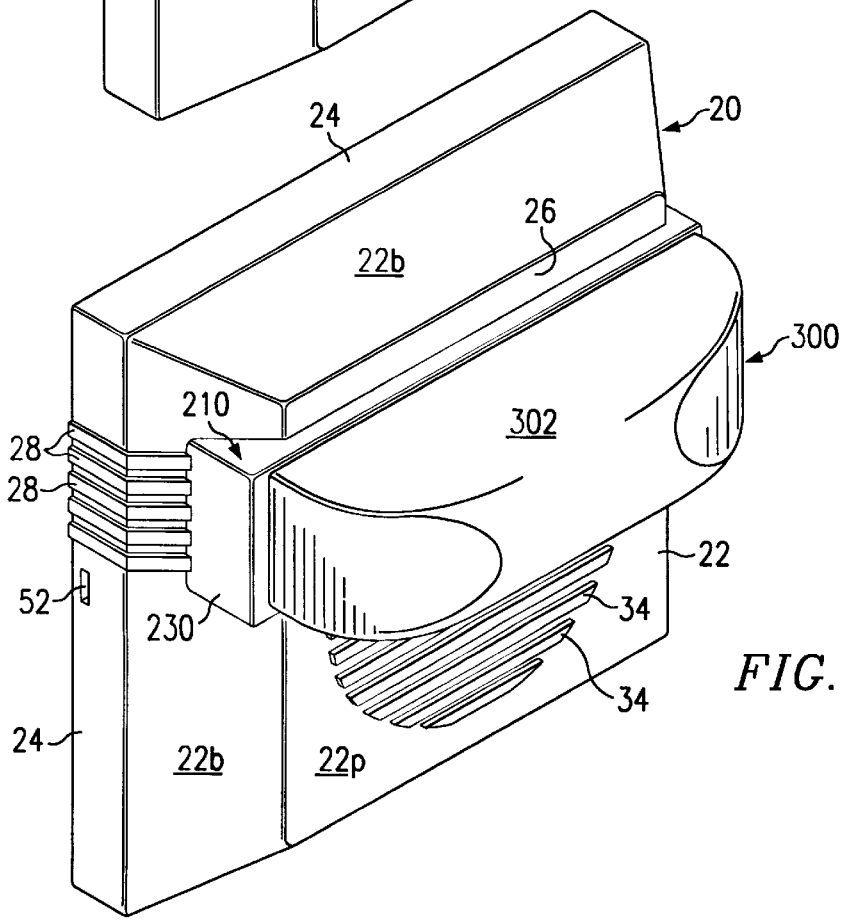
FIG. 2 is a ¾ front pictorial view of the audible-visible alarm.
Figure 4:
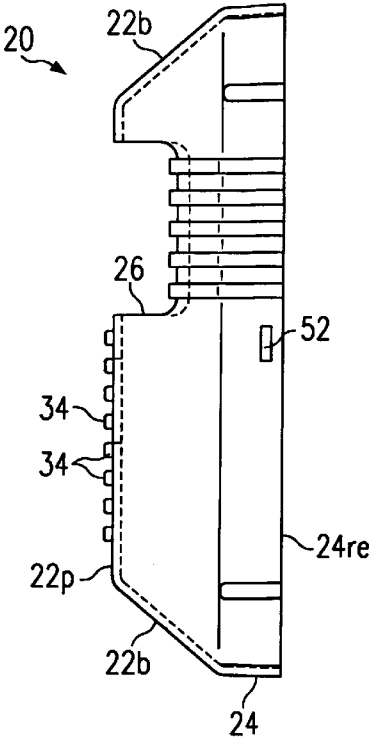
FIG. 4. is a side elevational view of the cover.
Figure 3:
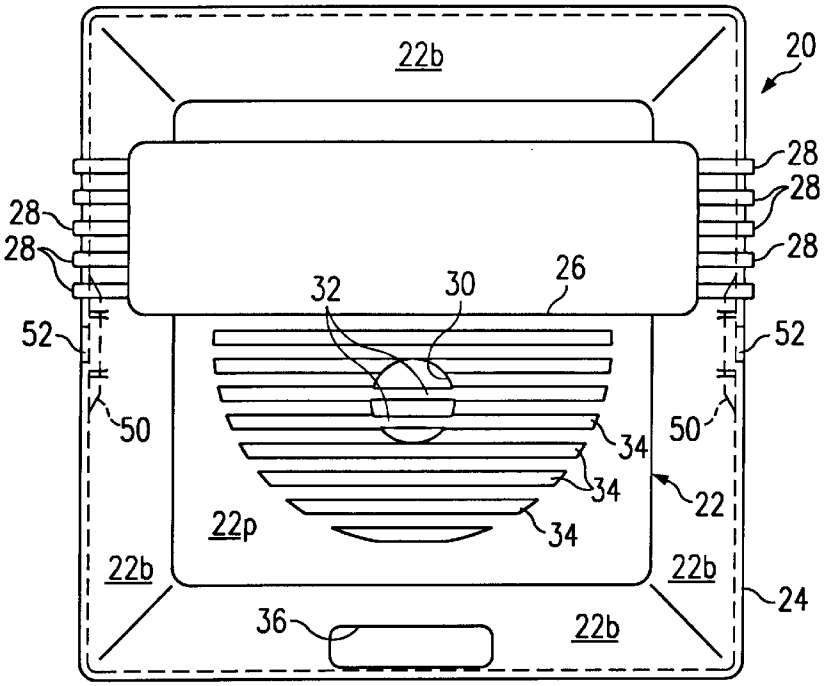
FIG. 3 is a front elevational view of the cover used for both of the alarms of FIGS. 1 and 2.
Figure 5:
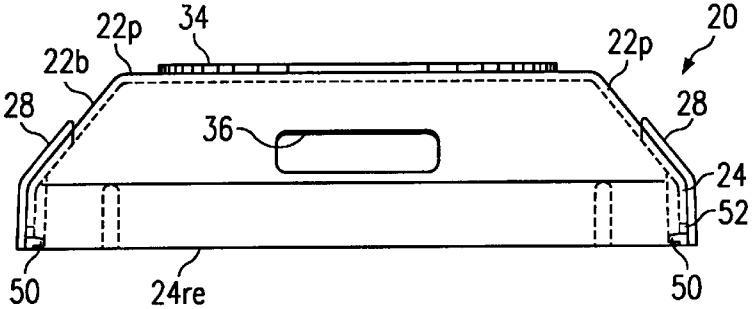
FIG. 5 is a bottom view of the cover.
Figure 7:
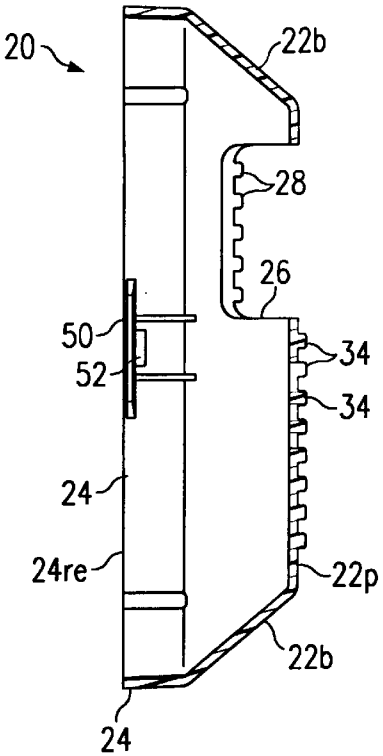
FIG. 7 is a side cross-sectional view of the cover, taken along the lines 7—7 of FIG. 6.
Figure 6:
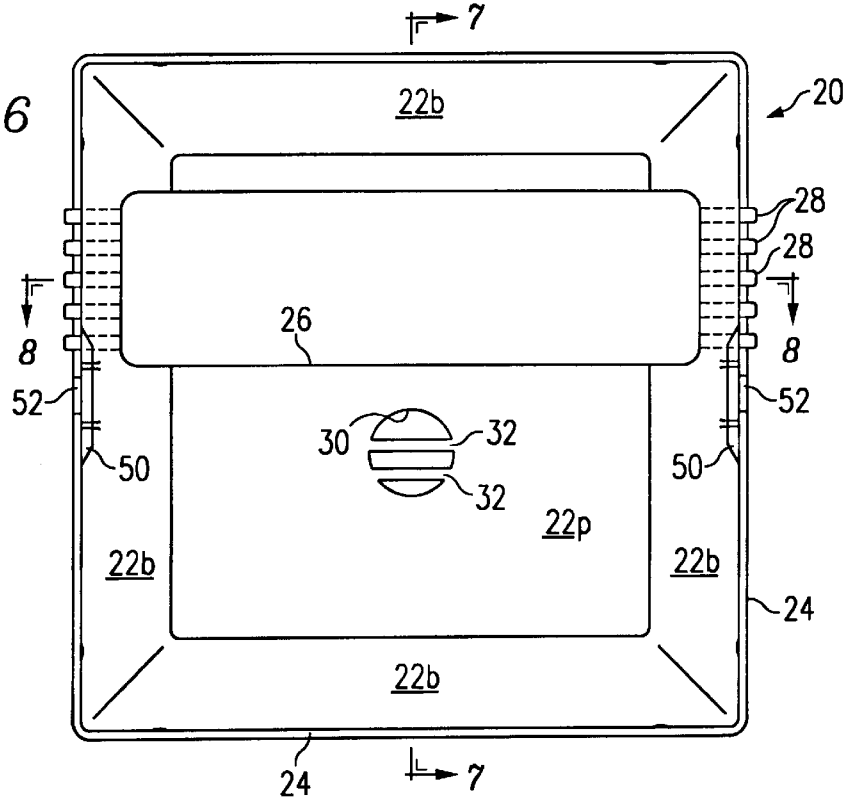
FIG. 6 is a rear elevational view of the cover.
Figure 8:
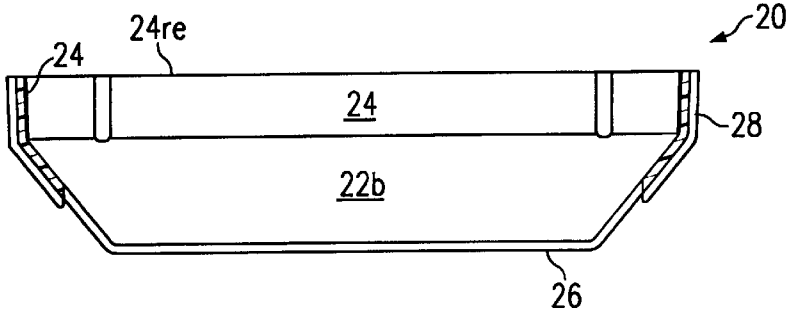
FIG. 8 is a top cross-sectional view of the cover, taken along the lines 8—8 of FIG. 6.
Figure 10:
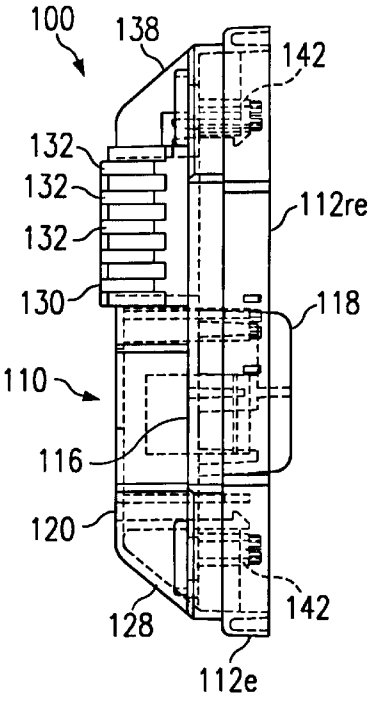
FIG. 10. is a side elevational view of the base member of FIG. 9.
Figure 9:
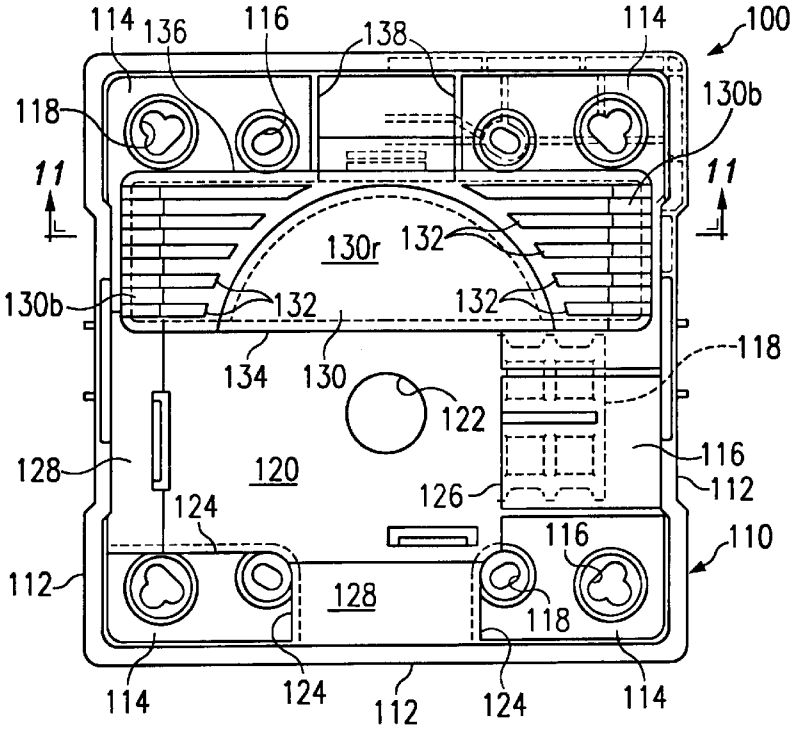
FIG. 9 is a front elevational view of the base member of the audible alarm of FIG. 1.
Figure 11:
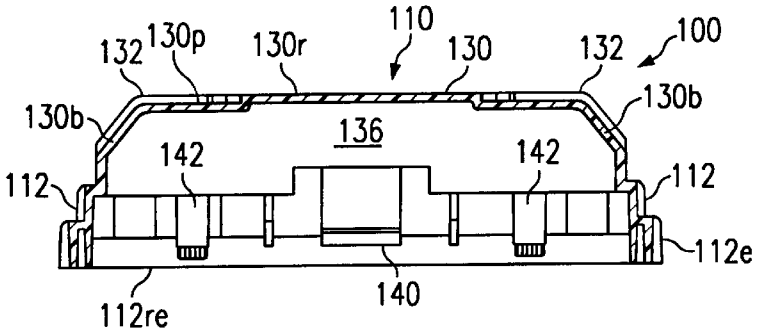
FIG. 11 is a bottom cross-sectional view of the base member of FIG. 9, taken along the lines 11—11 of FIG. 9.
Figure 13:
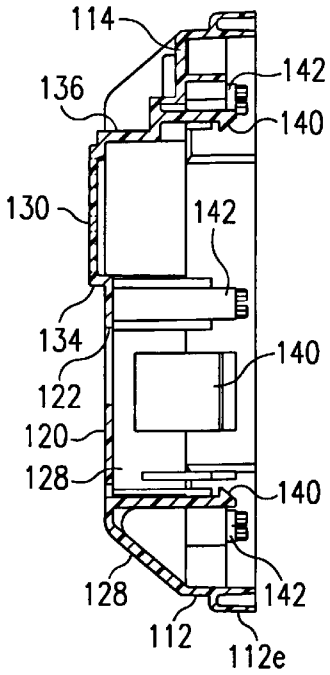
FIG. 13 is a side cross-sectional view of the cover, taken along the lines 13—13 of FIG. 12.
Figure 12:
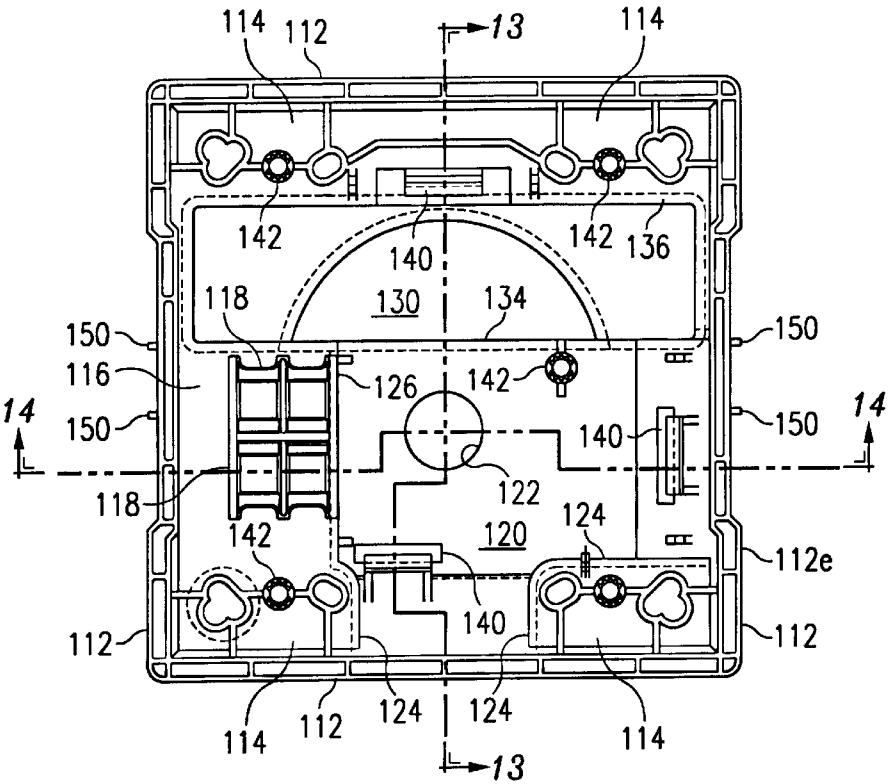
FIG. 12 is a rear elevational view of the base member of FIG. 9.
Figure 14:
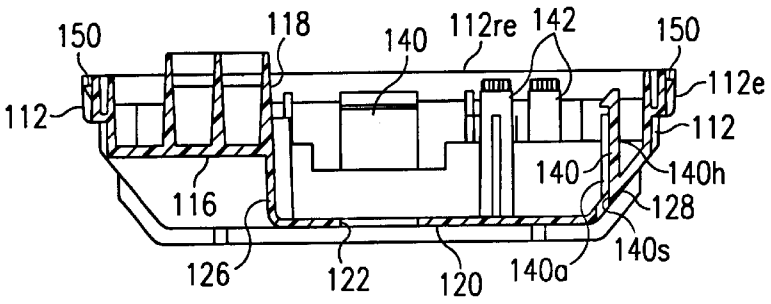
FIG. 14 is a bottom cross-sectional view of the base member of FIG. 9, taken along the lines 14—14 of FIG. 12.
Figure 16:
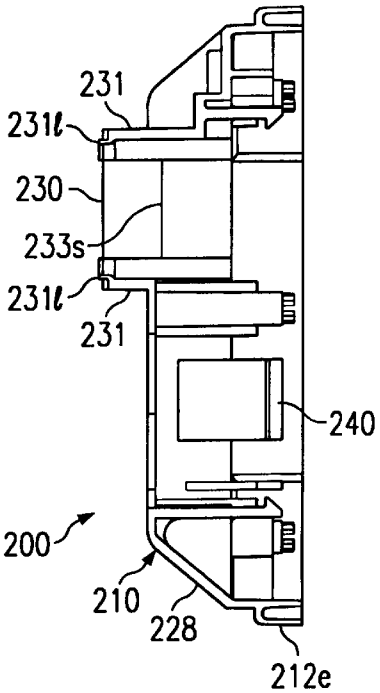
FIG. 16 is a side cross-sectional view of the base member of FIG. 15, taken generally along the lines 16—16 of FIG. 15.
Figure 15:
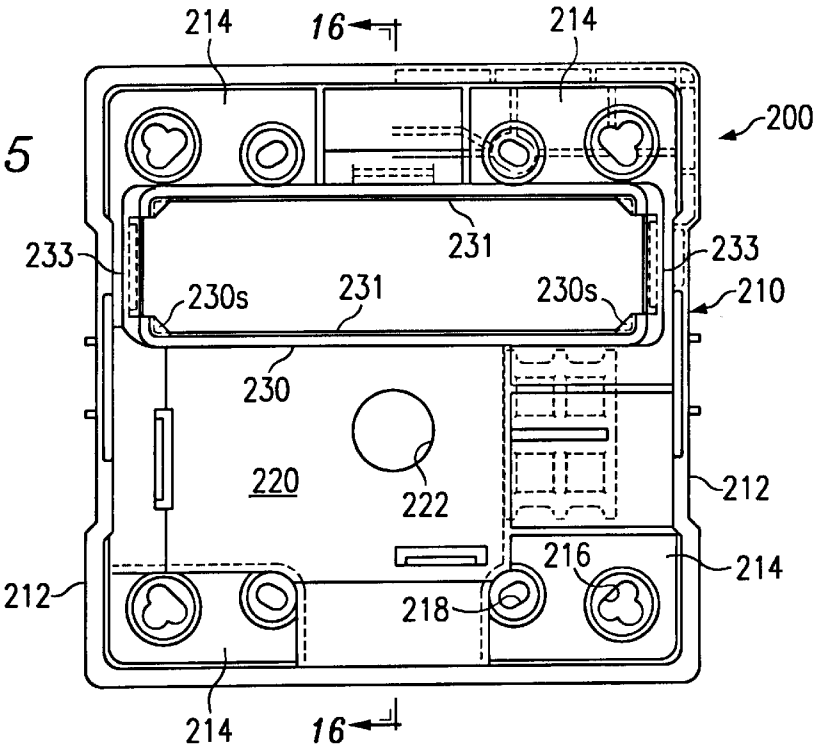
FIG. 15 is a front elevational view of the base member of the audible-visible alarm of FIG. 2.
Figure 17:
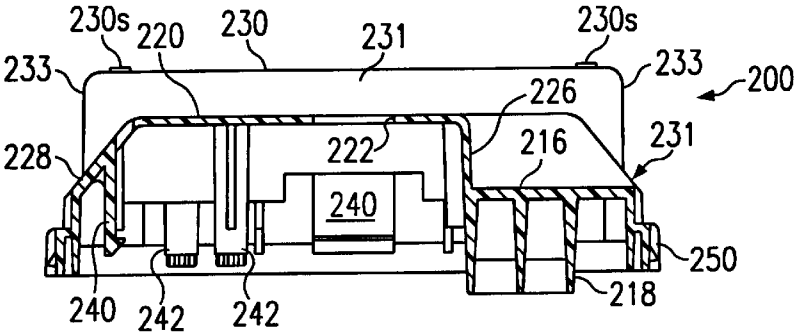
FIG. 17 is a bottom cross-sectional view of the base member of FIG. 15, take generally along the lines 17—17 of FIG. 15.
Figure 18:
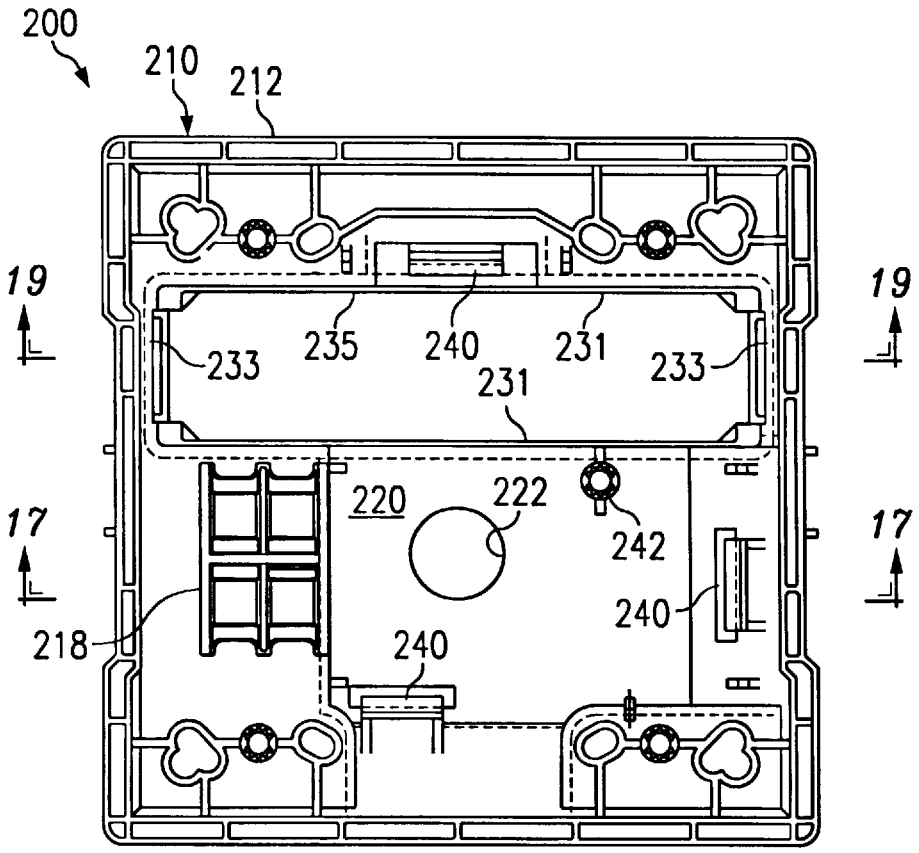
FIG. 18 is a rear elevational view of the base member of FIG. 15.

Both the audible alarm of FIG. 1 and the audible-visible alarm of FIG. 2 have the same cover 20, which is square in plan, has a front wall 22 having a square, generally planar portion 22*p* and beveled portions 22*b* along each edge of the planar portion. The beveled portions 22*b*, which slope at 50° with respect to the planar portion 22*p*, provide a large volume cavity and a low visual mass for the alarm. Side walls 24 extend rearwardly from and along the perimeter of the front wall 22 and terminate along rear edges 24*re* that lie in a plane for engagement with a wall surface adjacent a backbox (not shown) over which the alarm is installed. The front wall 22 has an opening 26, which is rectangular in plan and extends horizontally across the planar portion 22*p* and partway along each beveled portion 22*b*. The opening 26 is flanked by parallel ribs 28, which form a faux grille. A hole 30 in the front wall registers with a sound generator (not shown) and allows the sound to propagate more readily into the space in which the alarm is installed.

Grille bars 32 extend across the hole to mask it visually and prevent tampering with the sound generator, as required by UL for certification. Ribs 34 on the front wall, two of which are coextensive with the grille bars 32, form a semi-circular faux grille, which enhances the visual masking of the hole 30 by drawing a viewer's eye to a prominent decorative element. The ribs 34 also impart stiffness to the front wall of the cover. The shape of the faux grille may, of course, vary, and the faux grille can also be omitted, although some form of faux grille or real grille is desirable for esthetic reasons, including the graphic communication function referred to above. The rectangular feature 36 is a shallow depression for a self-adhesive label.

The cover is used interchangeably with an audible alarm unit 100 (FIGS. 9 to 14) and an audible/visible alarm unit 200 (FIGS. 15 to 19). The drawings show only the bases 110 and 210 of the alarm units 100 and 200, inasmuch as suitable electronics, sounders, and strobe lamps that can be used in the units are well-known. The bases 110 and 210 are identical in most respects, and the same reference numerals used for the base 110, increased by 100, are applied to the base 210.

The base 110 of the audible alarm unit 100 has peripheral side walls 112, the rear edge portions 112*e* of which are of a honeycomb construction with two wall segments joined by cross-ribs, thus making the perimeter of the base strong and rigid. The rear edges 112*re* of the side walls lie in a plane so as to engage a wall adjacent a backbox. The front wall of the base 110 is formed by several generally planar wall portions that lie parallel to the rear edges 112*re* of the side walls, to wit:

A rectangular (in plan) screw land wall portion 114 in each corner, each having two screw holes 116 and 118, each of which is surrounded internally and externally by stiffening ribs and is configured and positioned to permit the base 110 to be attached to the several forms of backboxes that are in current use. Reference may be made to U.S. patent application Ser. No. 08/524,865 referred to above for a further description of suitable arrangements of sets of screw holes. The screw land wall portions 114 are located intermediate of the rear edges and the frontal extremity of the base to permit the use of relatively short screws.

A support wall portion 116 for a terminal block receptacle 118, which extends rearwardly toward the backbox and is configured to accept terminal blocks with screws for connecting the electronics unit of the alarm with wire pairs coming into and, often, leaving the backbox.

A main front wall portion 120, which defines in part a cavity in the base 110 for the electronics unit and a sounder (neither shown) and has a hole 122 to enhance the propagation of sound into the space in which the alarm is installed. The main front wall portion 120 is connected to the screw land wall portions 114 and the terminal block support wall portion 116 by connecting walls 124, 126 that lie substantially perpendicular to the rear edge plane of the base (but at a small angle for better ejection from the mold) and to portions of the side walls 112 by beveled wall portions 128.

A projecting wall portion 130, which is rectangular in plan, has a generally planar portion 130*p* and beveled end portions 130*b* at each end of the planar portion 130*p* and out from adjacent wall portions such that it is received in the hole 26 in the cover 20 (see FIG. 1) with its frontal surfaces generally flush with the surfaces of the cover that border the hole 26. The external surface of the projecting wall portion 130 has a semi-circular, raised plain surface portion 130r that adjoins the faux grille (ribs 34) of the cover to form a circular motif and parallel ribs 132 that form a faux grille adjoining and aligned with the ribs 28 on the cover 20. The faux grille on the projecting portion and the cover visually masks the edges of the hole 26 and the projecting wall portion 130. The projecting wall portion 130 is joined to the main front wall portion 120 by a lower connecting wall 134 and to the wall portions 114 by an upper connecting wall 136, the latter being stiffened by ribs 138.

The side of the base 100 that faces the wall and the backbox (see particularly FIGS. 12 to 14) has, in addition to the terminal block support 118 described above, the following elements:

Three resilient mounting arms 140, which receive in a snap-in relation and secure by resilient engagement a circuit board carrying the sounder and the electronics for driving the sounder (neither shown). Each arm 140 has a hook portion 140*h* for capturing the edge of the board and abutment portions 140*h*, one on each side of the hook portion, that have shoulders on which the edge of the board rests. The hook portion of each arm is formed by a boss in the female mold, thus leaving a slot 140*s* in the base adjacent the juncture of each hook portion and the wall of the base from which the hook portion projects (see FIG. 14, at the right).

Five posts 142, each with a star-ribbed tip, for affixation by a press-fit/interference-fit of an electrically-insulating cover board (not shown), that covers the rear of the base 110 and has holes for the screws by which the base is attached to the backbox and for the terminal block support 118. The cover card has holes that receive the posts and is retained frictionally by engagement of the walls of the holes with the ribbed tips.

The cover 20 snaps onto the base 110 and is retained by projecting pairs of lugs 150 on each side of the base 110 and an inwardly projecting rib 50 on each side of the cover 20 that is captured behind (with respect to the frontal aspect of the base) the lugs on the base. A slot 52 adjacent each rib 50 accepts a screwdriver tip or other implement to facilitate displacing the edge of the cover outwardly to release it from the base.

Figure 19:
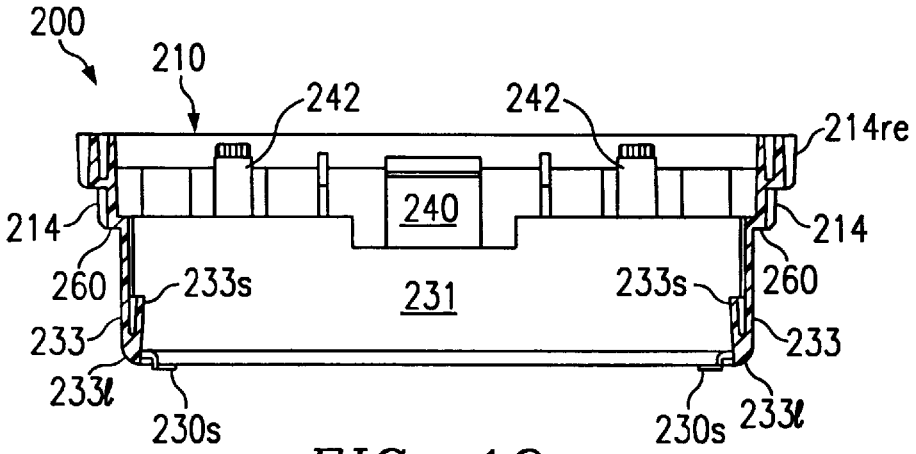
FIG. 19 is a bottom cross-sectional view of the base member of FIG. 15, taken along the lines 19—19 is FIG. 18.

As mentioned above, the base 210 of the audible/visible alarm 200 (FIGS. 15 to 19) is the same as the base 110 of the audible alarm 100. The only difference is that the projecting wall portion 130 of the base 110 is replaced by a receptacle 230 for a strobe light unit. The receptacle 230 has side walls 231 that form junctures with the wall portions 214, 216 and 220 and end walls 233 that form junctures with narrow connecting wall portions 260 joined to the side walls 214 (FIG. 19). The walls 231 and 233 lie substantially perpendicular (but at a small angle for better ejection from the mold) to the rear plane (defined by the edges 212*re*) of the base 210. The front edges of the walls 231 and 233 define an opening 235 that accepts a strobe light unit 300 (See FIG. 2), which is known per se and can be of various configurations. Typically, a strobe lamp unit has a base plate that carries a reflector and a strobe lamp that is supported by the reflector in a predetermined position relative to the reflector. The base, reflector and lamp are covered by a transparent cover 302 (see FIG. 2), which is, preferably, molded from an optical grade "Lexan®". A suitable strobe lamp unit is described and shown in U.S. Pat. No. 5,475,361, issued Dec. 12, 1995, and entitled "Strobe Warning Light," which is hereby incorporated by reference. The edges of the lamp unit receptacle 230 that define the opening have lips 231*l* and 233*l* for positioning the cover on the end walls of the receptacle 230, the edge of the cover resting on the edge of the receptacle outwardly of the lips 231*l* and inwardly of the lips 233*l*. A resilient snap-fit hooked arm at each end of the cover snaps under a projecting, rearwardly facing shoulder 233*s* on the inner surface of the end wall 233 of the receptacle. The base of the lamp unit is captured between shoulders on the cover, tabs on the reflector, and a shoulder 230*s* at each corner of the receptacle 230. Other arrangements for attaching a strobe lamp unit can be used with the receptacle 230.

The receptacle 230 of the base 210 is received through the opening 26 in the cover 20, as shown in FIG. 2, the light unit thus projecting out from the cover a substantial distance to enable light from the strobe lamp to be directly projected from the lamp and also reflected from the reflector into the space in which the alarm is located. Obviously, the electronic unit (not shown) of the unit audible/visible alarm unit 200 has circuitry for both driving the sound generator and firing the strobe lamp. The electronic unit is on a circuit board that is supported on the base in the manner described above in connection with the audible alarm unit 100.

We claim:

1. An alarm assembly comprising an alarm unit selected from an audible alarm unit and an audible-visible alarm unit; and a cover adapted for use interchangeably with the audible alarm unit and the audible-visible alarm unit and detachably connected to the selected alarm unit;

the cover having a front wall and side walls extending generally rearwardly from the front wall, the cover defining a rear cavity that contains the selected alarm unit and the front wall having an opening and a front surface;

the audible alarm unit having a base member adapted to support a sound generating unit, the base member having screw holes in selected positions adapted to receive screws by which the audible alarm unit is adapted to be attached to an electrical backbox and a projecting wall portion receivable with a close peripheral clearance in the opening in the front wall of the cover, the projecting wall portion having a front surface contoured and configured to match contours and configurations of adjacent portions of the front surface of the front wall of the cover such that the front surface of the cover and the front surface of the projecting wall portion of the base of the audible alarm unit are visually unitary; and the audible-visible alarm unit having a base member adapted to support a sound generating unit and a light generating unit that includes a strobe lamp unit having a mounting plate, a strobe lamp and a transparent strobe lamp cover, the base having screw holes in selected positions adapted to receive screws by which the audible-visible alarm unit is adapted to be attached to an electrical backbox, and having a receptacle adapted to receive the strobe lamp unit, the receptacle being defined by peripheral walls that are receivable with a close peripheral clearance in the opening in the cover and project out from the front surface of the cover so as to enable light from the strobe lamp unit to be emitted laterally and frontally with respect to the front surface of the cover.

2. An alarm assembly according to claim 1 wherein the base member of the audible alarm unit has a front wall, from which the projecting wall portion projects as a raised protuberance, and side walls extending generally rearwardly from the front wall, the front wall and side walls forming a cavity that is adapted to receive the sound generating unit in recessed relation with respect to rear edges of the side walls.

3. An alarm assembly according to claim 1 wherein the base member of the audible-visible alarm unit has a front wall, from which the peripheral walls defining the receptacle project, and side walls extending generally rearwardly from the front wall, the front wall and side walls forming a cavity that is adapted to receive the sound generating unit and the light generating unit in recessed relation to rear edges of the side walls.

4. An alarm assembly according to claim 2 wherein the front wall of the cover and the front wall of the base member of the audible alarm unit have registering openings to facilitate transmission of sound from the sound generating unit.

5. An alarm assembly according to claim 3 wherein the front wall of the cover and the front wall of the base member of the audible-visible alarm unit have sound openings to facilitate transmission of sound from the sound generating unit.

6. An alarm assembly according to claim 5 wherein the front wall of the cover has parallel straight grille bars extending across the sound opening.

7. An alarm assembly according to claim 6 wherein the front wall of the cover has parallel straight ribs adjacent the grille bars and forming a faux grille, at least some of the ribs being aligned with and contiguous to the grille bars.

8. An alarm assembly according to claim 7 wherein the projecting wall portion of the base member of the audible alarm unit has projecting ribs that form a faux grille.

9. An alarm assembly according to claim 1 wherein the cover is substantially rectangular in front elevation.

10. An alarm assembly according to claim 9 wherein the front wall of the cover includes a substantially planar and rectangular portion and beveled side portions along the margins of the planar portion, and the side walls of the cover are oriented substantially orthogonally with respect to the planar portion.

11. An alarm assembly according to claim 1 wherein the cover is substantially rectangular in front elevation, the front wall of the cover includes a substantially planar and rectangular portion and beveled side portions along margins of the planar portion, the side walls of the cover are oriented substantially orthogonally with respect to the planar portion, and the opening in the front wall of the cover is elongated and substantially rectangular in front elevation, extends entirely across the planar portion and partway along opposite beveled side portions, and its oriented with its edges parallel to the side walls of the cover.

12. An alarm assembly according to claim 11 wherein the opening in the front wall of the cover is offset with respect to a centerline of the cover parallel to a longer axis of the opening.

13. An alarm assembly according to claim 11 wherein the opening in the front wall of the cover is located between a centerline of the cover parallel to a longer axis of the opening and an edge of the cover.

14. An alarm assembly according to claim 11 wherein the base member of the audible alarm unit has a front surface that is shaped and dimensioned generally to match a rear surface of the cover so as to be received to the rear of the cover in nested relation to the cover.

15. An alarm assembly according to claim 11 wherein the base member of the audible-visible alarm unit has a front surface that is shaped and dimensioned generally to match a rear surface of the cover so as to be received to the rear of the cover in nested relation to the cover.

16. An alarm assembly comprising an alarm unit selected from an audible alarm unit and an audible-visible alarm unit; and a cover adapted for use interchangeably with the audible alarm unit and the audible-visible alarm unit and detachably connected to the selected alarm unit;

the cover being substantially rectangular in front elevation and having a front wall and side walls extending generally rearwardly from the front wall and defining a rear cavity containing the selected alarm unit, the front wall having a rectangular opening having longer edges parallel to opposite edges of the cover and a front surface;

the audible alarm unit having a base member that is shaped and dimensioned to be received in nested relation to the rear of the cover and is adapted to support a sound generating unit, the base member having screw holes in selected positions adapted to receive screws by which the audible alarm unit is adapted to be attached to an electrical backbox and a projecting wall portion receivable with a close peripheral clearance in the opening in the front wall of the cover, the projecting wall portion having a front surface contoured and configured to match contours and configurations of adjacent portions of the front surface of the front wall of the cover such that the front surface of the cover and the front surface of the projecting wall portion of the base of the audible alarm unit are visually unitary; and the audible-visible alarm unit having a base member that is shaped and dimensioned to be received in nested relation to the rear of the cover and is adapted to support a sound generating unit and a light generating unit that includes a strobe lamp unit having a mounting plate, a strobe lamp and a transparent strobe lamp cover, the base having screw holes in selected positions adapted to receive screws by which the audible-visible alarm unit is adapted to be attached to an electrical backbox, and having a receptacle adapted to receive the strobe lamp unit, the receptacle being defined by peripheral walls that are receivable with a close peripheral clearance in the opening in the cover and project out from the front surface of the cover so as to enable light from the strobe lamp unit to be emitted laterally and frontally with respect to the front surface of the cover.

17. An alarm assembly according to claim 16 wherein the front wall of the cover, a front wall of the base member of the audible alarm unit, and a front wall of the base member of the audible-visible alarm unit have registering openings to facilitate transmission of sound from the sound generating unit.

18. An alarm assembly according to claim 17 wherein the front wall of the cover has parallel straight grille bars extending across the sound opening.

19. An alarm assembly according to claim 18 wherein the front wall of the cover has parallel straight ribs adjacent the grille bars and forming a faux grille, at least some of the ribs being aligned with and contiguous to the grille bars.

20. An alarm assembly according to claim 19 wherein the projecting wall portion of the base member of the audible alarm unit has projecting ribs that form a faux grille.

21. An alarm assembly according to claim 16 wherein the front wall of the cover includes a substantially planar and rectangular portion and beveled side portions along margins of the planar portion, the side walls of the cover are oriented substantially orthogonally with respect to the planar portion, and the opening in the front wall of the cover extends entirely across the planar portion and partway along opposite beveled side portions.

22. An alarm assembly according to claim 21 wherein the opening in the front wall of the cover is offset with respect to a centerline of the cover parallel to a longer axis of the opening.

23. An alarm assembly according to claim 21 wherein the opening in the front wall of the cover is located between a centerline of the cover parallel to a longer axis of the opening and an edge of the cover.

24. An alarm assembly according to claim 21 wherein at least portions of the projecting wall portion of the base member of the audible alarm unit adjacent shorter edges of the opening in the front wall of the cover have evenly spaced apart straight ribs that are parallel to the longer edges of the opening and form a faux grille and portions of the beveled portions of the front wall of the cover and the side walls of the cover have ribs aligned with the ribs on the projecting portion of the base member of the audible alarm unit.

* * * * *